US011470929B1

(12) United States Patent
Jenkins

(10) Patent No.: US 11,470,929 B1
(45) Date of Patent: Oct. 18, 2022

(54) CONVERTIBLE AMBULATORY DEVICE KIT

(71) Applicant: Kenneth D. Jenkins, Jamaica, NY (US)

(72) Inventor: Kenneth D. Jenkins, Jamaica, NY (US)

( * ) Notice: Subject to any disclaimer, the term of this patent is extended or adjusted under 35 U.S.C. 154(b) by 12 days.

(21) Appl. No.: 17/315,892

(22) Filed: May 10, 2021

Related U.S. Application Data

(60) Provisional application No. 63/022,683, filed on May 11, 2020.

(51) Int. Cl.

| | |
|---|---|
| ***A45B 5/00*** | (2006.01) |
| ***A61H 3/02*** | (2006.01) |
| ***A47C 13/00*** | (2006.01) |
| ***A47B 85/04*** | (2006.01) |
| *A45B 9/00* | (2006.01) |

(52) U.S. Cl.
CPC ..... *A45B 5/00* (2013.01); *A47B 85/04* (2013.01); *A47C 13/00* (2013.01); *A61H 3/02* (2013.01); *A45B 2009/002* (2013.01); *A45B 2009/005* (2013.01); *A61H 2003/0222* (2013.01); *A61H 2003/0233* (2013.01)

(58) Field of Classification Search
CPC ..... A45B 5/00; A61H 3/02
See application file for complete search history.

(56) References Cited

U.S. PATENT DOCUMENTS 2,408,604 A 10/1946 Brickson
2,490,380 A * 12/1949 Schweppenheiser .... A61H 3/02 135/68
3,537,748 A * 11/1970 Knapp ..... A47C 4/20 297/118
3,817,483 A 6/1974 Garvey
3,886,962 A * 6/1975 Diamontis ..... A61H 3/02 403/322.2
4,184,503 A 1/1980 Nakajima
4,253,478 A * 3/1981 Husa ..... A61H 3/02 135/74
4,437,480 A * 3/1984 Husa ..... A61H 3/02 403/100
4,747,423 A * 5/1988 Hansen ..... A61H 3/02 135/68
5,090,434 A 2/1992 Hagen
5,325,879 A 7/1994 Burns
(Continued)

*Primary Examiner* — Noah Chandler Hawk
(74) *Attorney, Agent, or Firm* — Goldstein Law Offices, P.C.

(57) ABSTRACT

A kit for converting a crutch to a cane, table, or bench is disclosed. The kit includes a crutch, a picker, a tabletop panel, a foot pad, and a seat cushion. The crutch includes an upper section connected to a middle section by a first pivot and a lower section connected to the middle section by a second pivot. The first pivot and the second pivot orient the sections of crutch to position the crutch in an upright crutch configuration, a table configuration, a cane configuration, or a bench configuration. The picker attaches to the upper section when the crutch is in the table configuration. The foot pad attaches to the picker to stabilize the picker upright. The tabletop panel attaches to the upper section when the crutch is in the table configuration. The seat cushion attaches to the lower section when the crutch is in the bench configuration.

19 Claims, 10 Drawing Sheets

(56) References Cited

U.S. PATENT DOCUMENTS

| | | | | |
|---|---|---|---|---|
| 5,482,070 | A | 1/1996 | Kelly | |
| 7,104,271 | B2 | 9/2006 | Larson et al. | |
| 7,614,414 | B2 * | 11/2009 | Jamshidi | A61H 3/02 297/118 |
| 8,146,615 | B1 * | 4/2012 | Rodriguez | A61H 3/0244 135/74 |
| 9,386,830 | B2 | 7/2016 | Crowhurst | |
| 2004/0139995 | A1 * | 7/2004 | Hsieh | A61H 3/02 135/69 |
| 2012/0167933 | A1 | 7/2012 | Vegvary | |
| 2022/0095753 | A1 * | 3/2022 | Mehl | A61H 3/0288 |

* cited by examiner

CONVERTIBLE AMBULATORY DEVICE KIT

CROSS-REFERENCE TO RELATED APPLICATIONS

This application claims the benefit of priority of U.S. Provisional Patent Application Ser. No. 63/022,683, filed on May 11, 2020, the contents of which are relied upon and incorporated herein by reference in their entirety.

TECHNICAL FIELD

The present disclosure relates generally to ambulatory devices. More particularly, the present disclosure relates to a crutch that is capable of being selectively converted from a crutch to a cane, to a standing table, or to a bench.

BACKGROUND

For individuals who are disabled or injured in their lower limbs or back, the crutch and the cane are vital and indispensable instruments. So much so that oftentimes these individuals cannot perform their daily tasks, without either a crutch or a cane. Indeed, it is very difficult to stand, get around, or do much of anything with an injured leg, foot, or back. The reduced mobility caused from a disability or injury to these areas can be very frustrating and painful to these individuals, especially when they have to repeatedly get up on their own to retrieve necessary things, such as food and water.

The majority of crutches and canes used today are strictly ambulatory devices in that they are designed solely for walking. Indeed, the majority, if not all, crutches and cranes are devoid of means for doing anything other than providing assistance to a disabled or injured individual in ambulating. This is disadvantageous because when traveling a seat and/or table may not be available and all the individual may have is their crutch or cane. Accordingly, there is a need for a walking device that may selectively convert from a crutch or a cane to a table or bench so as to provide a means to place objects upon or sit as desired by the user.

While these units may be suitable for the particular purpose employed, or for general use, they would not be as suitable for the purposes of the present disclosure as disclosed hereafter.

In the present disclosure, where a document, act or item of knowledge is referred to or discussed, this reference or discussion is not an admission that the document, act or item of knowledge or any combination thereof was at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional technologies have been discussed to facilitate the present disclosure, no technical aspects are disclaimed and it is contemplated that the claims may encompass one or more of the conventional technical aspects discussed herein.

BRIEF SUMMARY

An aspect of an example embodiment in the present disclosure is to provide a crutch capable of selectively converting to a cane. Accordingly, the present disclosure provides a crutch including an upper section including a crutch pad, a handle, and a pivot joint, and a lower section, wherein the pivot joint enables the upper section to fold downwardly in a position adjacent to the lower section, thereby exposing the handle such that the handle is the upper most part of the crutch.

An aspect of an example embodiment in the present disclosure is to provide a crutch capable of converting to a table. Accordingly, the present disclosure provides a picker including a handle and a pair of grabbing arms, a foot, a tabletop panel, and a crutch including an upper section including a crutch pad, a handle, and a pivot joint, and a lower section, wherein the pivot joint enables the upper section to rotate to a perpendicular orientation relative to the lower section and the picker is attachable to the crutch pad in a parallel orientation relative to the lower section so as to serve as a leg that maintains the crutch in an upright position to serve as a table. The picker is attachable to the crutch pad via the handle and the foot is attachable to the pair of grabbing arms to help stabilize the leg and table when in an upright position. The tabletop panel attaches the upper section so as to serve as a tabletop capable of supporting items placed thereon.

An aspect of an example embodiment in the present disclosure is to provide a crutch capable of converting to a bench. Accordingly, the present disclosure provides a cushion and a crutch including an upper section including a crutch pad, a handle, and a first pivot joint, and middle section, and a lower section including a second pivot joint, wherein the first pivot joint enables the upper section to rotate to a perpendicular orientation relative to the middle section and the second pivot joint enables the lower section to pivot to a perpendicular orientation relative to the middle section and parallel with the upper section so as to form a substantially U-shaped bench, in which the upper section defines a first leg of the bench, the lower section defines the second leg of the bench, and the middle section defines the seating area of the bench. The lower section includes an attachment member for removably receiving the cushion so as to provide a comfortable sitting area.

The present disclosure addresses at least one of the foregoing disadvantages. However, it is contemplated that the present disclosure may prove useful in addressing other problems and deficiencies in a number of technical areas. Therefore, the claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

BRIEF DESCRIPTION OF THE DRAWINGS

In the drawings, like elements are depicted by like reference numerals. The drawings are briefly described as follows.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION OF THE PREFERRED EMBODIMENTS

Figure 1:
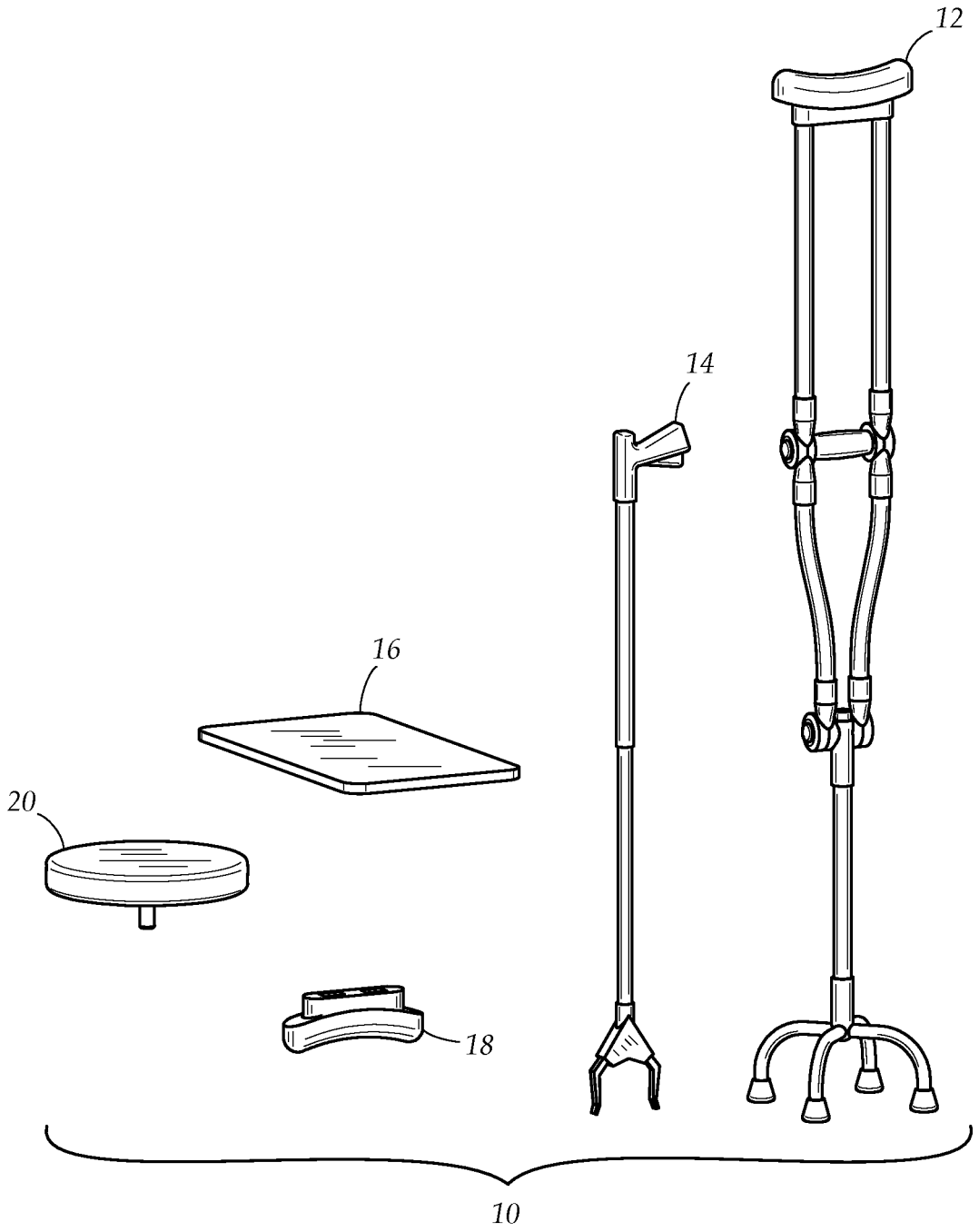
FIG. 1 is a perspective view of the convertible ambulatory device kit, illustrating the components of the kit according to one embodiment of the present disclosure.

FIG. 1 illustrates a convertible ambulatory device kit 10 for converting a crutch or a cane to a table or bench. The convertible ambulatory device kit 10 comprises a crutch 12, a picker 14, a tabletop panel 16, a foot pad 18, and a seat cushion 20.

Referring now to FIGS. 2A-4A and 4D-4G, the crutch 12 comprises an upper section 22, a middle section 24, a lower section 26, a first locking pivot joint 28, and a second locking pivot joint 30. The middle section 24 is positioned between the upper section 22 and the lower section 26. The first locking pivot joint 28 pivotally connects the upper section 22 to the middle section 24 and the second locking pivot joint pivotally connects the lower section 26 to the middle section 24.

The upper section 22 includes a first end 32 including a crutch pad 34 having a first fastener 35, a second end 36 including a handle 38 having a first end 38A opposite a second end 38B, and a first pair of elongated tubular members 40 extending parallelly relative to each other from the crutch pad 34 to the first locking pivot joint 28. The first end 32 is opposite the second end 36.

The lower section 26 comprises and an elongated tubular member 42 including a first end 44, a second end 46 including a crutch tip 48, and a longitudinal bore 50. The first end 44 is opposite the second end 46. The longitudinal bore 50 extends from the first end 44 to the second end 46. The first end 44 comprises an opening 52 providing access to the longitudinal bore 50. The longitudinal bore 50 is configured to removably receive the seat cushion 20. In embodiments, the lower section can be configured to be adjustable for adjusting the height of the crutch. For example, in embodiments, the lower section 26 may be telescopically configured with respect to the middle section 24 such that the lower section 26 is in telescopic arrangement with the middle section 24 to extend and retract relative thereto. In embodiments, the crutch tip 48 comprises a four-legged tip.

The middle section 24 comprises a second pair of elongated tubular members 54 each including a first end 56 connected to the second end 36 of the upper section 22 at the handle 38 via the first locking pivot joint 28 and a second end 58 connected to the first end 44 of the elongated tubular member 42 via the second locking pivot joint 30. The second pair of elongated tubular members 54 extend parallelly relative to each other from the first locking pivot joint 28 to the second locking pivot joint 30. In embodiments, the second pair of elongated tubular members 54 curve inwardly towards each other at their second ends 58 such that the distance between the second pair of elongated tubular members 54 at the second ends 58 is less than the distance between the second pair of elongated tubular members 54 at the first end 56 of the middle section 24.

The first locking pivot joint 28 comprises a first ratchet joint 28A disposed on the first end 38A of the handle and a second ratchet joint 28B disposed on the second end 38B of the handle 38. The first ratchet joint 28A and the second ratchet joint 28B each including an upper receiving pivot arm 60 affixed to an elongated tubular member of the first pair of elongated tubular members 40, a lower receiving pivot arm 62 affixed to an elongated tubular member of the second pair of elongated tubular members 54, and a spring biased push button 64. When depressed, the spring biased push buttons 64 enable rotation of the upper receiving pivot arms 60 relative to the lower receiving pivot arms 62. When released, the spring biased push buttons 64 lock the upper receiving pivot arms 60 and the lower receiving pivot arms 62 in position.

Figure 2A:
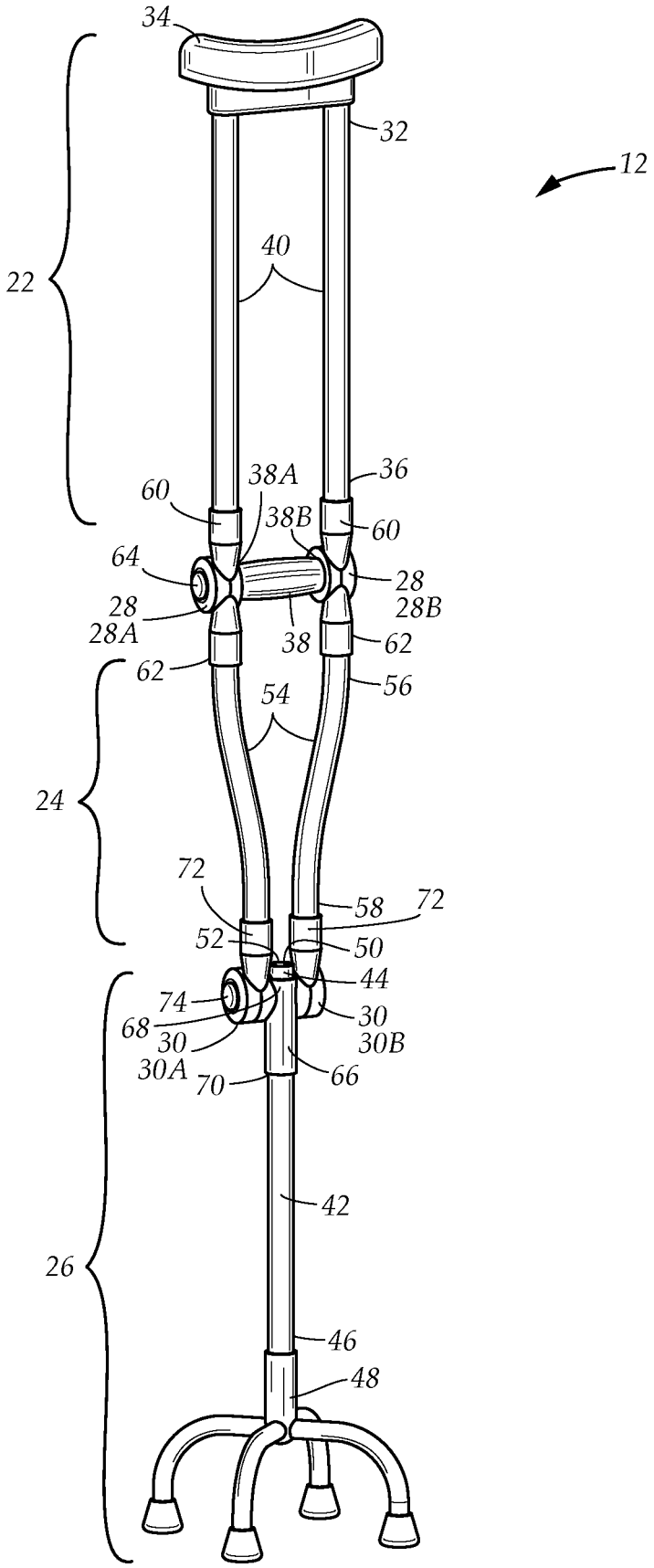
FIG. 2A is a perspective view of the crutch of the convertible ambulatory device kit, illustrating the crutch in an upright and unfolded configuration in the crutch configuration according to one embodiment of the present disclosure.
Figure 2B:
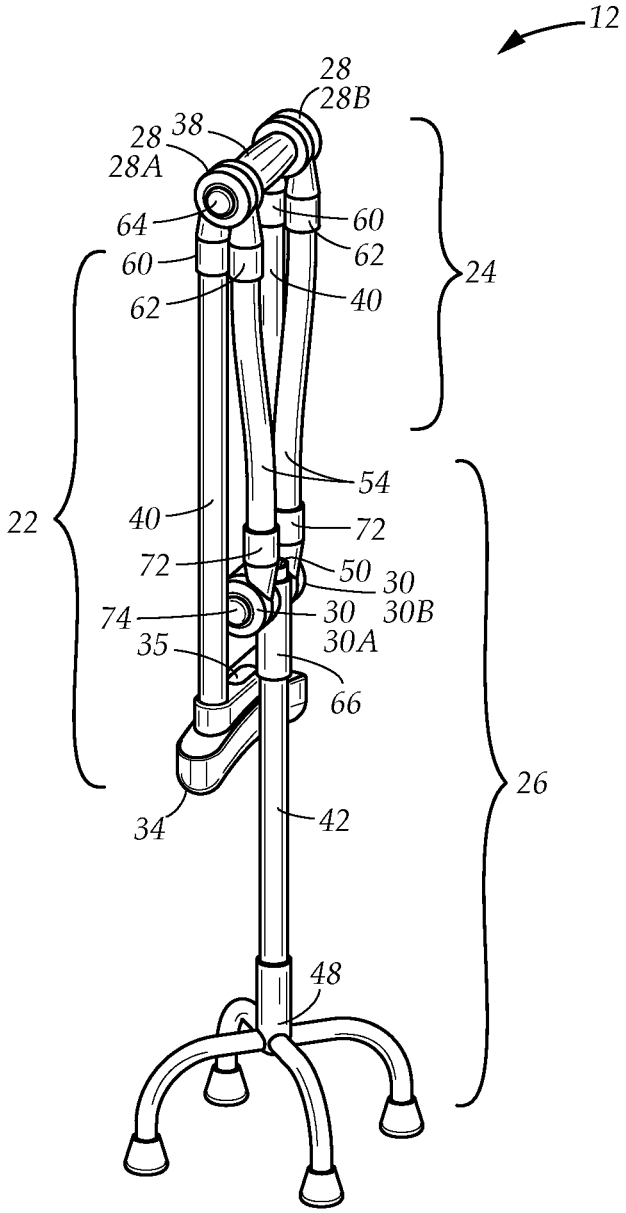
FIG. 2B is a perspective view of the crutch of the convertible ambulatory device kit, illustrating the crutch in an upright and folded configuration to form the cane configuration of the crutch according to one embodiment of the present disclosure.
Figure 4A:
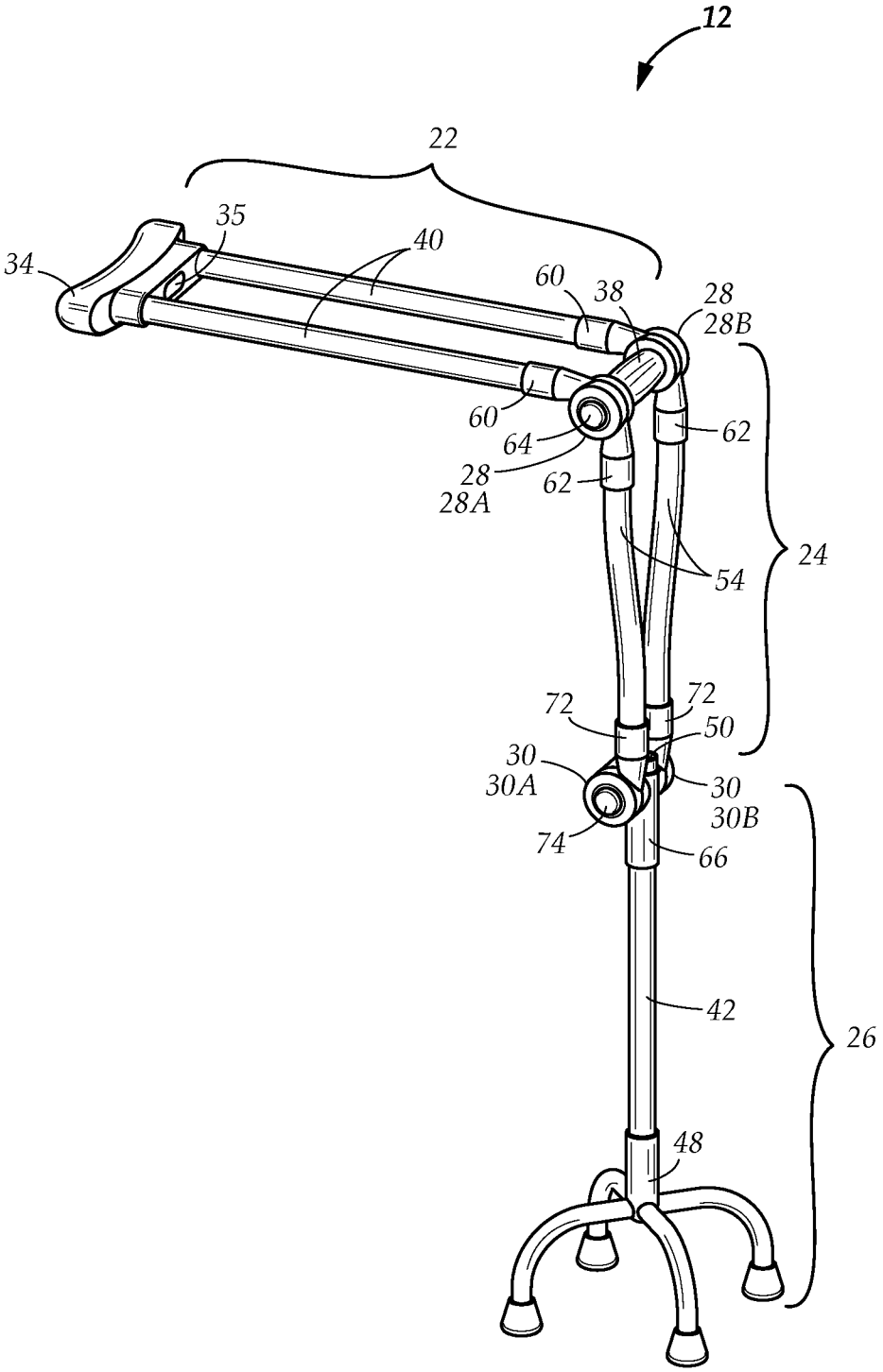
FIG. 4A is a perspective view of the crutch of the convertible ambulatory device kit, illustrating the crutch in an upright and partially folded configuration, in which the upper section of the crutch is perpendicular relative to the middle section and the lower section of the crutch, so as to form the table configuration of the crutch according to one embodiment of the present disclosure.

The first locking pivot joint 28 is pivotable between an unfolded position, partially folded position, and entirely folded position to allow the upper section 22 to pivot relative to the middle section 24. In the unfolded position, the upper receiving pivot arms 60 and the lower receiving pivot arms 62 are coplanar relative to each other and form substantially a 180-degree angle therebetween such that the upper section 22 is positioned upright and coplanar relative to the middle section 24, as shown by FIG. 2A. In the partially folded position, the upper receiving pivots arms 60 and the lower receiving pivot arms 62 are orthogonal relative to each and form substantially a 90-degree angle therebetween such that upper section 22 is positioned orthogonal relative to the middle section 24, as shown by FIG. 4A. In the entirely folded position, the upper receiving pivots arms 60 and the lower receiving pivot arms 62 are folded onto each other and are parallelly aligned forming a smaller acute angle therebetween such that the upper section 22 positioned adjacent to the lower section 26 as well as parallel and noncoplanar with the lower section 26, as shown by FIG. 2B. The first locking pivot joint 28 is configured to lock the upper section in the unfolded position, the partially folded position, and/or the entirely folded position via the spring biased push buttons 64.

The second locking pivot joint 30 comprises a third ratchet joint 30A and a fourth ratchet joint 30B connected by a tubular receiving member 66 having a first end 68 and a second end 70 opposite the first end 68. The third ratchet joint 30A and the fourth ratchet joint 30B each comprise an upper receiving pivot arm 72 affixed to an elongated tubular member of the second pair of elongated tubular members 54 and a spring biased push button 74. When depressed, the spring biased push buttons 74 enable rotation of the upper receiving pivot arms 72 relative to the lower tubular receiving member 66. When released, the spring biased push buttons 74 lock rotation of the upper receiving pivot arms 72 relative to the lower tubular receiving member 66 in position. The tubular receiving member 66 includes a longitudinal bore (not shown) extending from the first end 68 to the second end 70 of the tubular receiving member 66. The first end 44 of the elongated tubular member 42 of the lower section 26 extends through the longitudinal bore of tubular receiving member 66 and is affixed therein. In embodiments, the elongated tubular member 42 is slidably disposed within the tubular receiving member 66 such that the elongated tubular member 42 is in telescopic arrangement with the tubular receiving member 66. In this way, the elongated tubular member 42 can be extended and retracted relative to the tubular receiving member 66 so as to adjust the height of the crutch 12.

The second locking pivot joint 30 is pivotable between a parallel position and an orthogonal position to allow the lower section 26 to pivot relative to the middle section 24. In the parallel position, the upper receiving pivot arms 72 and the tubular receiving member 66 are coplanar relative to each other and form substantially a 180-degree angle therebetween such that the lower section 26 is positioned coplanar relative to the middle section 24, as shown by FIGS. 2A and 2B. In the orthogonal position, the upper receiving pivot arms 72 and the tubular receiving member 66 are orthogonal relative to each other and form substantially a 90-degree angle therebetween such that the lower section 26 is positioned orthogonal relative to the middle section 24. The second locking pivot joint 30 is configured to lock the lower section in the parallel position and/or the orthogonal position via the spring biased push buttons 74.

When the first locking pivot joint 28 is in the unfolded position and the second locking pivot joint 30 is in the parallel position the crutch 12 is in an upright crutch configuration, as shown by FIG. 2A, in which the crutch 12 is operable as a regular crutch. In the crutch configuration, the first pair of elongated tubular members 40, the second pair of elongated tubular members 54 and the elongated tubular member 42 of the lower section 26 are substantially coplanar relative to each other. When the first locking pivot joint 28 is in the entirely folded position and the second locking pivot joint 30 is in the parallel position the crutch 12 is in a cane configuration, as shown by FIG. 2B, in which the crutch 12 has been converted to a cane for operation as a cane. When the first locking pivot joint 28 is in the partially folded position and the second locking pivot joint 30 is in the parallel position the crutch 12 is in a table configuration, as shown by FIG. 4A. When the first locking pivot joint 28 is in the partially folded position and the second locking pivot joint 30 is in the orthogonal position the crutch 12 is in a bench configuration, as shown by 3A.

Figure 3A:
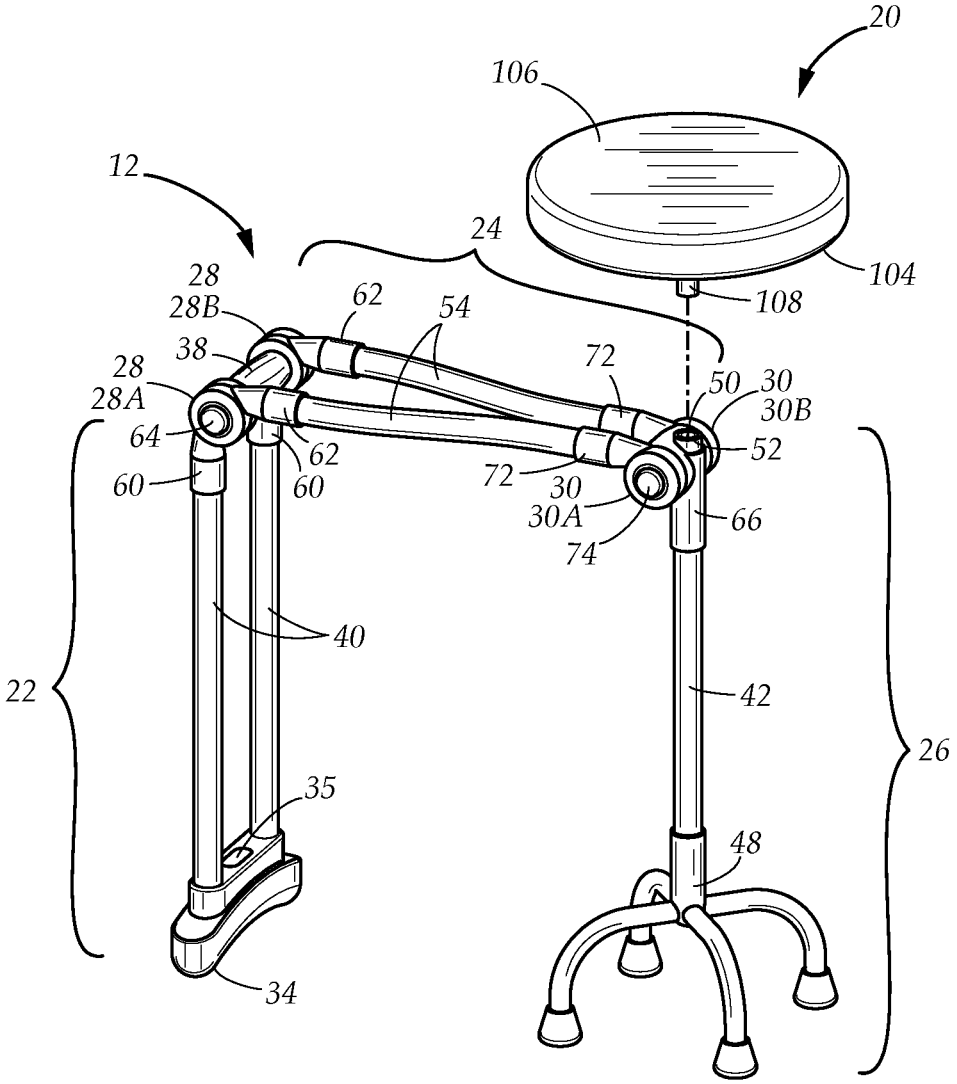
FIG. 3A is a perspective view of the crutch and the seat cushion of the convertible ambulatory device kit, illustrating the upper section of the crutch folded in a perpendicular orientation relative to the middle section of the crutch and the lower section of the crutch folded in a perpendicular orientation relative to the middle section of the crutch to form the bench configuration of the crutch, and illustrating one manner in which the seat cushion attaches to the lower section of the crutch to form a seat cushion on the middle section according to one embodiment of the present disclosure.
Figure 3B:
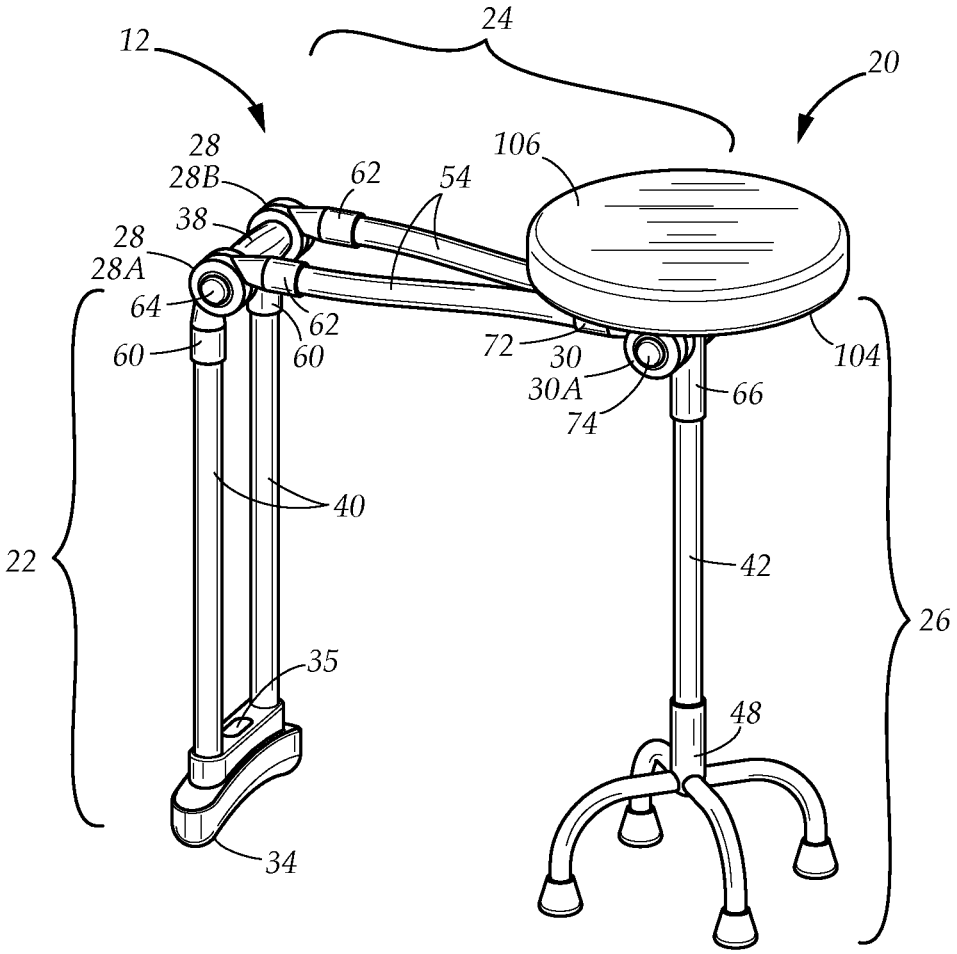
FIG. 3B is a perspective view of the crutch and the seat cushion of the convertible ambulatory device kit, illustrating the seat cushion attached to the middle section of the walking device when the walking device is in the bench configuration according to one embodiment of the present disclosure.

The seat cushion 20 comprises a base plate 104 including a cushion 106 and a protruding member 108. The cushion 106 is opposite the protruding member 108. The longitudinal bore 50 of the elongated tubular member 42 of the lower section 26 is configured to removably receive the protruding member 108 when the crutch 12 is in the bench configuration, as shown by FIG. 3A. The seat cushion 20 provides a sitting area on the middle section 24 of the crutch 12 when the crutch 12 is in the bench configuration, as shown by FIG. 3B.

Figure 4B:
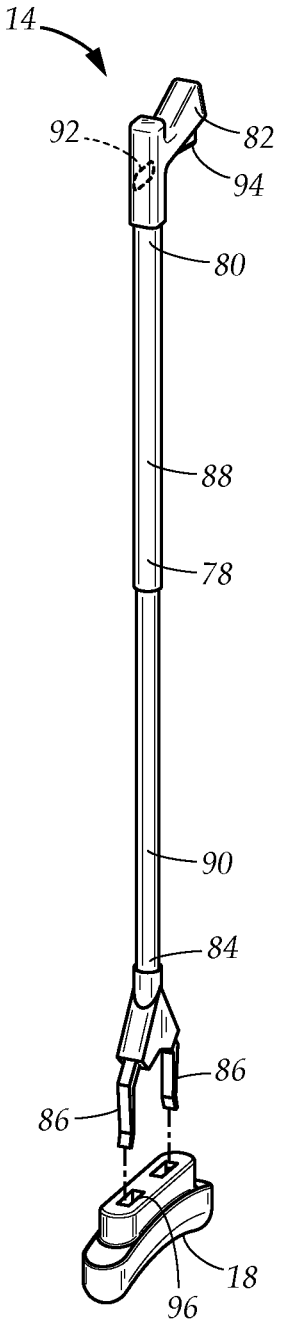
FIG. 4B is a perspective view of the picker of the convertible ambulatory device kit, illustrating one manner in which the foot of the convertible ambulatory device kit receives and attaches to the pair of grabbing arms of the picker according to one embodiment of the present disclosure.
Figure 4C:
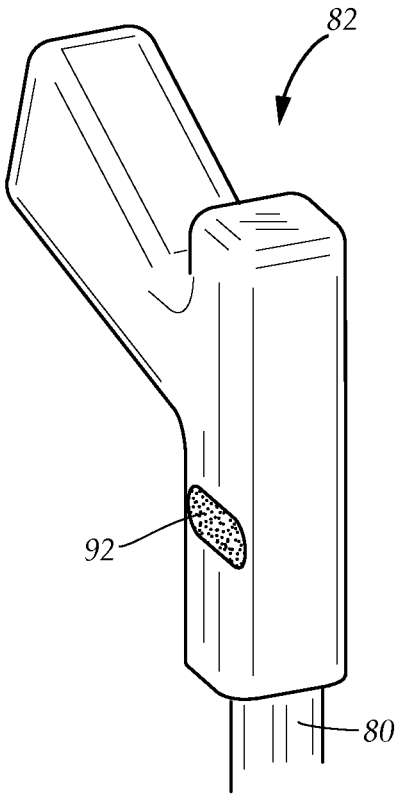
FIG. 4C is a close-up view of the handle of the picker of the convertible ambulatory device kit, illustrating the magnet of the handle that attaches to the magnet of the crutch pad to stabilize the crutch in the table configuration according to one embodiment of the present disclosure.
Figure 4D:
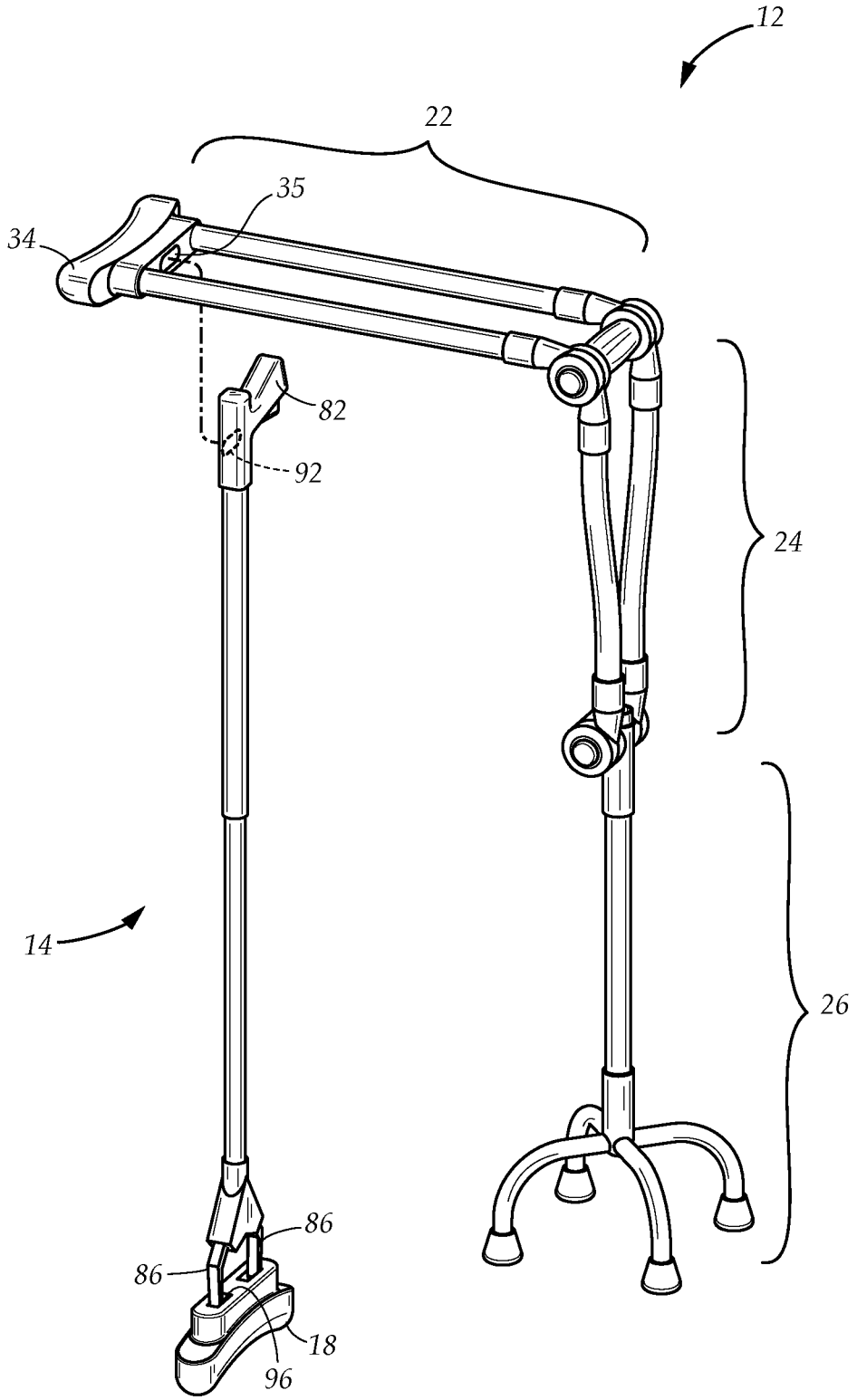
FIG. 4D is a perspective view of the picker and the crutch of the convertible ambulatory device kit, illustrating one manner in which the picker attaches to the crutch pad of the crutch to stabilize the crutch in the table configuration according to one embodiment of the present invention.

Referring now to FIGS. 4B and 4C, the picker 14 comprises an elongated shaft 78 including a first end 80 having a handle 82, a second end 84 opposite the first end 80 having a pair of grabbing arms 86, a first tubular member 88, and a second tubular member 90 slidably disposed within the first tubular member 88 in telescopic arrangement. The handle 82 includes a second fastener 92 and trigger 94 for actuating the pair of grabbing arms 86.

The foot pad 18 includes a pair of apertures 96 for receiving the pair of grabbing arms 86 and a grip-like material to further stabilize the picker 14 in an upright and vertical position by gripping a surface on which the picker 14 is positioned.

Figure 4E:
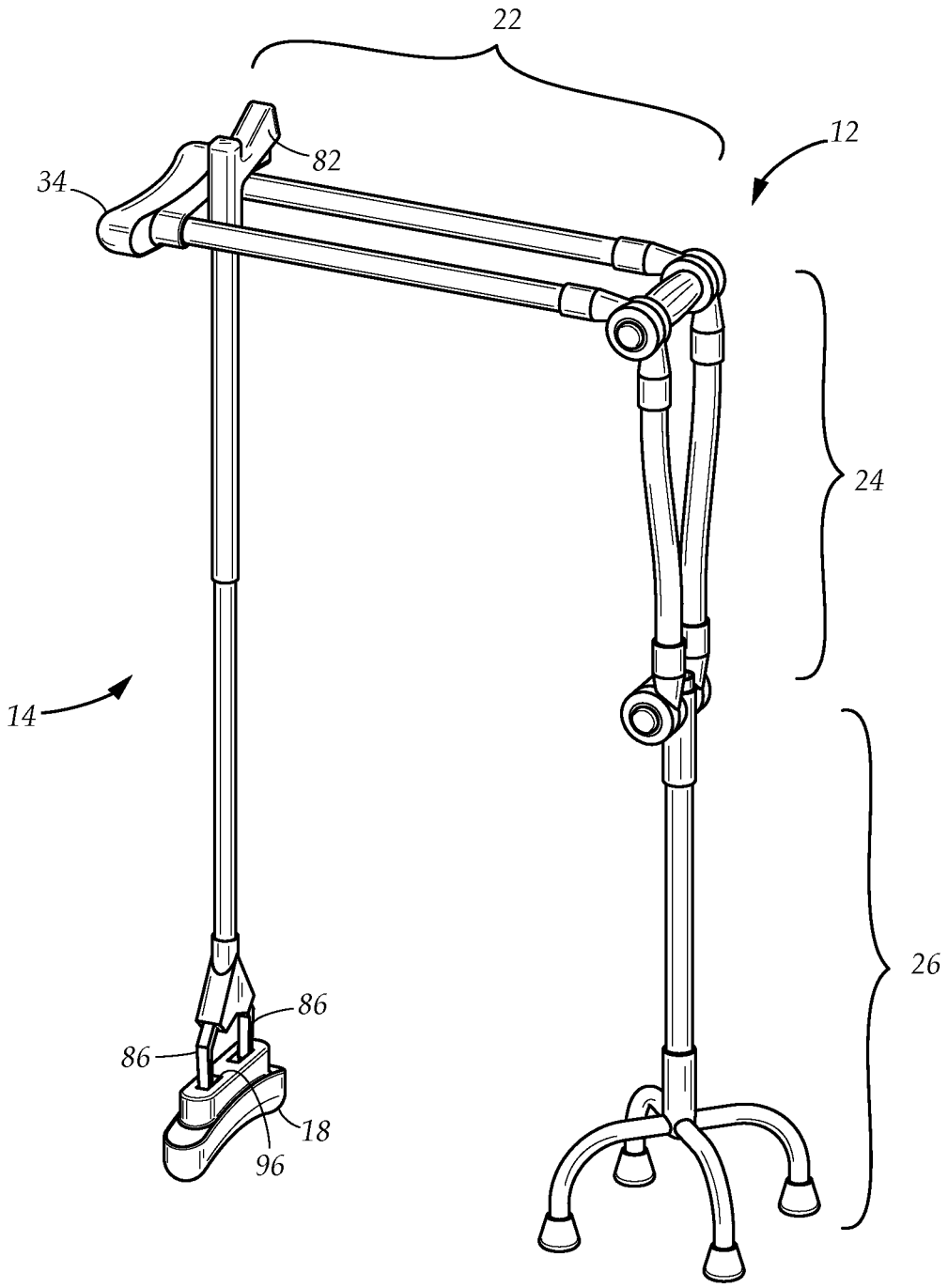
FIG. 4E is a perspective view of the picker attached to the crutch of the convertible ambulatory device kit in the table configuration, illustrating the convertible ambulatory device kit converted into a table according to one embodiment of the present disclosure.
Figure 4F:
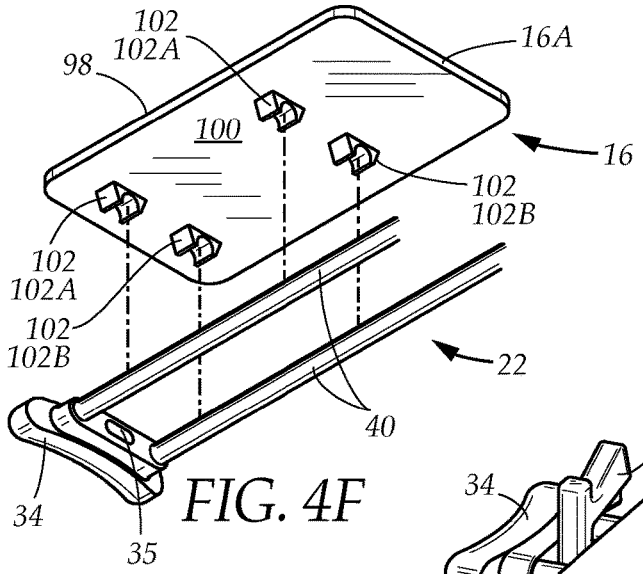
FIG. 4F is a perspective view of the tabletop panel and the upper section of the crutch of the convertible ambulatory device kit, illustrating one manner in which the tabletop panel attaches to the upper section when the crutch is in the table configuration according to one embodiment of the present disclosure.

Referring now to FIGS. 4D-4G, the second fastener 92 of the handle 82 is configured to mate with the first fastener 35 of the crutch pad 34 when the crutch 12 is in the table configuration so as to stabilize the crutch 12 in the table configuration. When attached to the crutch pad 34, the picker 14 serves as a leg opposite and parallel to the middle section 24 and lower section 26 of the crutch 12 that supports the upper section 22 in a horizontal orientation, as shown by FIG. 4E. In embodiments, the first fastener 35 and the second fastener 92 are magnetic so as to magnetically mate with each other. In one embodiment, the first fastener 35 and the second fastener 92 comprise a neodymium magnet. The foot pad 18 is attachable to the grabbing arms 86 of the picker 14 via the apertures 96 so as to serve as a base support for the picker 14. In this way, the foot pad 18 may provide further support to the crutch 12 when the picker 14 is attached to the crutch pad 34 in the table configuration.

Figure 4G:
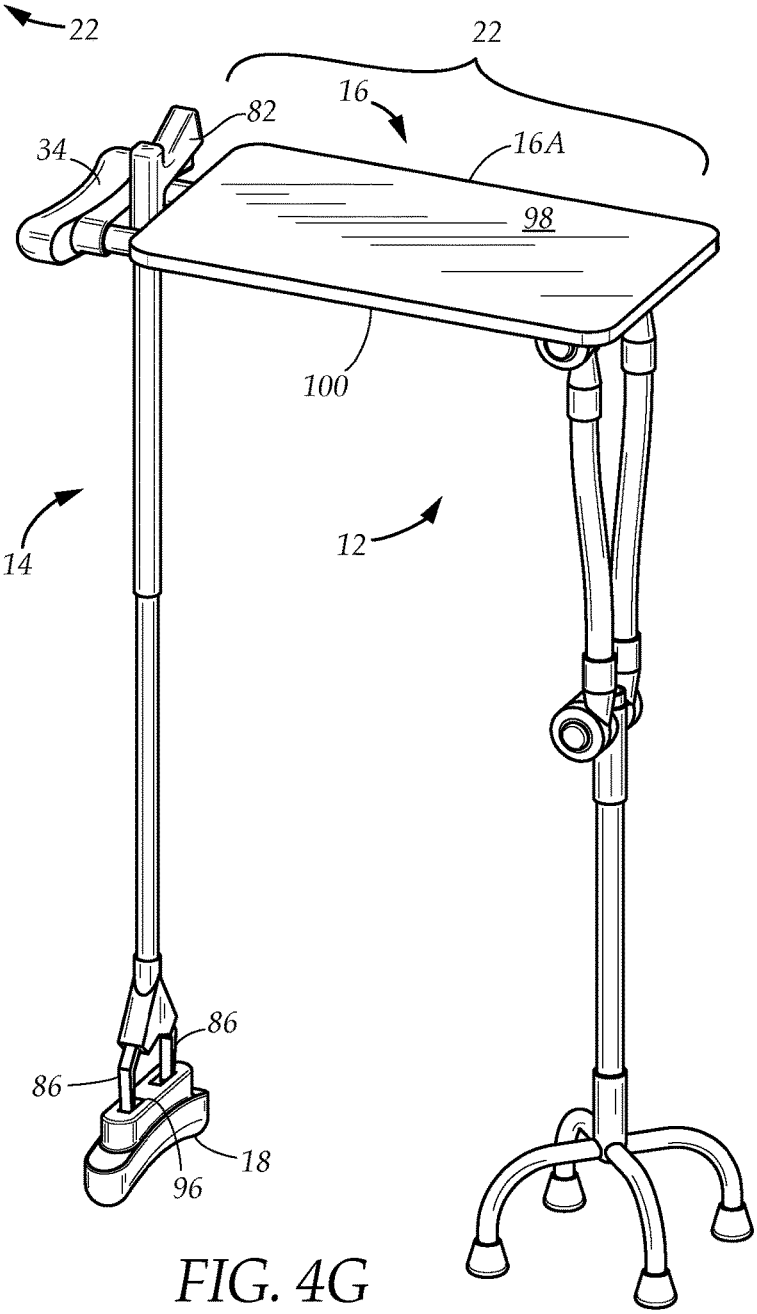
FIG. 4G is a perspective view of the of tabletop panel and the picker attached to upper section of the crutch of the convertible ambulatory device kit while the crutch is in the table configuration, illustrating the convertible ambulatory device kit converted into a table having a tabletop according to one embodiment of the present disclosure.

The tabletop panel 16 comprises a planar member 16A including top surface 98 and a bottom surface 100 opposite the top surface 98. The bottom surface 100 comprises one or more fasteners 102 configured to attach to the first pair of elongated tubular members 40 of the upper section 22 of the crutch 12 to orient the top surface 98 of the tabletop panel 16 away from the crutch 12 so as to serve as a horizontal tabletop when the crutch 12 is in table configuration, as shown by FIG. 4G. In embodiments, the tabletop panel 16 is rectangular and incudes a size that is equal to or less than a size of the upper section 22. In embodiments, the fasteners 102 comprise snap fasteners. In some embodiments, the tabletop panel 16 comprises a first pair of snap fasteners 102A and a second pair of snap fasteners 102B. The first pair of snap fasteners 102A are configured to fasten to a first elongated tubular member of the first pair of elongated tubular members 40 and the second pair of snap fasteners 102B are configured to fasten to a second elongated tubular member of the first pair of elongated tubular members 40.

Referring back to FIGS. 1-4G, in one operation of the convertible ambulatory device kit 10, the crutch 12 is converted to a table by pivoting the first locking pivot joint 28 such that the upper section 22 is folded in a perpendicular orientation relative to the middle section 24, attaching the foot pad 18 to the grabbing arms 86 of the picker 14, attaching the second fastener 92 of the picker 14 to the first fastener 35 of the crutch pad 34 in a vertical orientation so as to align the picker 14 with the middle section 24 and the lower section 26, and attaching the tabletop panel 16 to the first pair of elongated tubular members 40 of the upper section 22 so as to form a horizontal tabletop surface thereon. In embodiments, pivoting the first locking pivot joint 28 such that the upper section 22 is folded in a perpendicular orientation relative to the middle section 24 comprises depressing the spring biased push buttons 64 of the first ratchet joint 28A and third ratchet joint 28B simultaneously, folding the upper section 22 toward the lower section 26, and releasing the spring biased push buttons 64 when the upper section 22 is perpendicular relative to the middle section 24.

In another operation of the ambulatory device kit 10, the crutch 12 is converted to a bench by pivoting the first locking pivot joint 28 such that the upper section 22 is folded in a perpendicular orientation relative to the middle section 24, pivoting the second locking pivot joint 30 such that the elongated tubular member 42 of the lower section 26 is folded in a perpendicular orientation relative to the middle section 24 and the opening 52 of the longitudinal bore 50 of the elongated tubular member 42 is aligned with the middle section 24, and attaching the seat cushion 20 to the lower section 26 by inserting the protruding member 108 into the longitudinal bore 50. In some embodiments, the tabletop panel 16 is attached to the second pair of elongated tubular members 54 of the middle section 24 so as to form a horizontal tabletop surface thereon in addition to the seat cushion. In embodiments, pivoting the first locking pivot joint 28 such that the upper section 22 is folded in a perpendicular orientation relative to the middle section 24 comprises depressing the spring biased push buttons 64 of the first ratchet joint 28A and third ratchet joint 28B simultaneously, folding the upper section 22 toward the lower section 26, and releasing the spring biased push buttons 64 when the upper section 22 is perpendicular relative to the middle section 24. In embodiments, pivoting the second locking pivot joint 30 such that the elongated tubular member 42 is folded in a perpendicular orientation relative to the middle section 24 and the opening 52 of the longitudinal bore 50 is aligned with the middle section 24 comprises depressing the spring biased push button 74 of the third ratchet joint 30A and fourth ratchet joint 30B simultaneously, folding the lower section 26 toward the upper section 22, and releasing the spring biased push buttons 74 when the lower section 26 is perpendicular relative to the middle section 24.

It is understood that when an element is referred hereinabove as being "on" another element, it can be directly on the other element or intervening elements may be present therebetween. In contrast, when an element is referred to as being "directly on" another element, there are no intervening elements present.

Moreover, any components or materials can be formed from a same, structurally continuous piece or separately fabricated and connected.

It is further understood that, although ordinal terms, such as, "first," "second," "third," are used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

Spatially relative terms, such as "beneath," "below," "lower," "above," "upper" and the like, are used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly. The term "substantially" is defined as at least 95% of the term being described and/or within a tolerance level known in the art and/or within 5% thereof.

Example embodiments are described herein with reference to cross section illustrations that are schematic illustrations of idealized embodiments. As such, variations from the shapes of the illustrations as a result, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

In conclusion, herein is presented a convertible walking device kit. The disclosure is illustrated by example in the drawing figures, and throughout the written description. It should be understood that numerous variations are possible, while adhering to the inventive concept. Such variations are contemplated as being a part of the present disclosure.

What is claimed is:

1. A convertible ambulatory device kit for selectively converting a crutch or a cane into a table or a bench, comprising:

a crutch including an upper section, a middle section, a lower section, a first locking pivot joint, and a second locking pivot joint, the upper section including a first end including a crutch pad and a second end including a handle, the first end opposite the second end, the lower section including a first end and a second end including a crutch tip, the first end opposite the second end, the middle section including a first end and a second end, the first end of the middle section connected to the second end of the upper section at the handle via the first locking joint, the second end of the middle section connected to the first end of the lower section via the second locking pivot joint, the first locking pivot joint pivotable between an unfolded position, partially folded position, and entirely folded position to allow the upper section to pivot relative to the middle section, the upper section positioned upright and coplanar relative to the middle section when the first locking pivot joint is in the unfolded position, the upper section positioned orthogonal relative to the middle section when the first locking pivot joint is in the partially folded position, the upper section positioned adjacent to and parallel and noncoplanar with the lower section when the first locking pivot joint is in the entirely folded position, the first locking pivot joint locking the upper section in the unfolded position, the partially folded position, and the entirely folded position, the second locking pivot joint pivotable between a parallel position and an orthogonal position to allow the lower section to pivot relative to the middle section, the lower section positioned coplanar relative to the middle section when the second locking joint is in the parallel position, the lower section positioned orthogonal relative to the middle section when the second locking joint is in the orthogonal position, the second locking pivot joint locking the lower section in the parallel position and the orthogonal position;

wherein:

the crutch is in an upright crutch configuration when the first locking pivot joint is in the unfolded position and the second locking pivot joint is in the parallel position;

the crutch is in a table configuration when the first locking pivot joint is in the partially folded position and the second locking pivot joint is in the parallel position;

the crutch is in a cane configuration when the first locking pivot joint is in the entirely folded position and the second locking pivot joint is in the parallel position; and the crutch is in a bench configuration when the first locking pivot joint is in the partially folded position and the second locking pivot joint is in the orthogonal position.

2. The convertible ambulatory device kit of claim 1, further comprising:

a first fastener disposed on the crutch pad;

a picker comprising an elongated shaft including a first end having a handle and a second end having a pair of grabbing arms, the first end opposite the second end, the handle including a second fastener configured to mate with the first fastener of the crutch pad when the crutch is in the table configuration to stabilize the crutch in the table configuration; and a foot pad configured to receive the pair of grabbing arms of the picker to stabilize the picker in an upright position.

3. The convertible ambulatory device kit of claim 2, further comprising a tabletop panel including a top surface and a bottom surface, the top surface opposite the bottom surface, the bottom surface comprising one or more fasteners configured to attach to the upper section of the crutch to orient the top surface away from the crutch to serve as a horizontal tabletop when the crutch is in table configuration.

4. The convertible ambulatory device kit of claim 3, further comprising:

a seat cushion including a cushion and a protruding member, the cushion opposite the protruding member;

wherein:

the lower section comprises an elongated tubular member including a longitudinal bore extending from the first end of the lower section to the second end of the lower section, the first end including an opening providing access to the bore, the bore configured to removably receive the protruding member when the crutch is in the bench configuration to provide a sitting area on the middle section of the crutch.

5. The convertible ambulatory device kit of claim 4, wherein the upper section comprises a first pair of elongated tubular members extending parallelly relative to each other from the crutch pad to the first locking pivot joint.

6. The convertible ambulatory device kit of claim 5, wherein:

the middle section comprises a second pair of elongated tubular members extending parallelly relative to each other from the first locking pivot joint to the second locking pivot joint; and the second pair of elongated tubular members, the first pair of elongated tubular members, and the elongated tubular member of the lower section are coplanar relative to each other when the crutch is in the crutch configuration.

7. The convertible ambulatory device kit of claim 6, wherein the second pair of elongated tubular members curve inwardly towards each other at their second ends such that the distance between the second pair of elongated tubular members at the second end of the middle section is less than the distance between the second pair of elongated tubular members at the first end of the middle section.

8. The convertible ambulatory device kit of claim 7, wherein:

the handle includes a first end and a second end;

the first locking pivot joint includes a first ratchet joint disposed on the first end of the handle and a second ratchet joint disposed on the second end of the handle, the first ratchet joint and the second ratchet joint each including upper receiving pivot arms affixed to the first pair of elongated tubular members, lower receiving pivot arms affixed to the second pair of elongated tubular members, and a spring biased push button configured to enable rotation of the first ratchet joint and the second ratchet joint when depressed and configured to lock the first ratchet joint and the second ratchet joint in position when released.

9. The convertible ambulatory device kit of claim 8, wherein:

the second locking pivot joint comprises a third ratchet joint and a fourth ratchet joint connected by a tubular receiving member having a first end and a second end, the third ratchet joint and the fourth ratchet joint comprising upper receiving pivot arms affixed to the second pair of elongated tubular members and a spring biased push button configured to enable rotation of the third ratchet joint and the fourth ratchet joint when depressed and configured to lock the third ratchet joint and the fourth ratchet joint in position when released, the tubular receiving member including a longitudinal bore extending from the first end to the second end of the tubular receiving member; and the first end of the elongated tubular member of the lower section extends through the longitudinal bore of the tubular receiving member and is affixed therein.

10. The convertible ambulatory device kit of claim 9, wherein the first fastener and the second fastener are magnetic so as to magnetically mate with each other.

11. The convertible ambulatory device kit of claim 10, wherein the crutch tip comprises a four-legged tip.

12. The convertible ambulatory device kit of claim 11, wherein:

the elongated shaft of the picker includes a first tubular member and a second tubular member slidably disposed within the first tubular member in telescopic arrangement;

the handle of the picker includes a trigger for actuating the pair of grabbing arms; and the foot pad includes a pair of apertures for receiving the pair of grabbing arms and a grip-like material to further stabilize the picker in an upright position.

13. A method of converting an ambulatory device into a table, comprising:

providing a crutch including an upper section, a middle section, a lower section, a first locking pivot joint, and a second locking pivot joint, the upper section including a first end including a crutch pad and a second end including a handle, the lower section including a first end and a second end including a crutch tip, the middle section including a first end and a second end, the first end of the middle section connected to the second end of the upper section at the handle via the first locking joint, the first locking pivot joint pivotable to allow the upper section to pivot relative to the middle section;

providing a picker comprising an elongated shaft including a first end having a handle and a second end having a pair of grabbing arms, the handle including a second fastener configured to mate with the first fastener of the crutch pad;

providing a foot pad configured to receive the pair of grabbing arms of the picker to stabilize the picker in an upright position;

providing a tabletop panel including a top surface and a bottom surface, the bottom surface comprising one or more fasteners configured to attach to the upper section of the crutch to orient the upper surface of the tabletop panel away from the crutch;

pivoting the first locking pivot joint such that the upper section is folded in a perpendicular orientation relative to the middle section;

attaching the foot pad to the grabbing arms of the picker;

attaching the second fastener of the picker to the first fastener of the crutch pad; and attaching the tabletop panel to the upper section so as to form a horizontal tabletop surface thereon.

14. The method of claim 13, wherein:

the first locking pivot joint includes a first ratchet joint disposed on the first end of the handle and a second ratchet joint disposed on the second end of the handle, the first ratchet joint and the second ratchet joint each including upper receiving pivot arms affixed to the upper section, lower receiving pivot arms affixed to the middle section, and a spring biased push button configured to enable rotation of the first ratchet joint and the second ratchet joint when depressed and configured to lock the first ratchet joint and the second ratchet joint in position when released.

15. The method of claim 14, wherein:

pivoting the first locking pivot joint such that the upper section is folded in a perpendicular orientation relative to the middle section comprises depressing the spring biased push button of each of the first ratchet joint and third ratchet joint simultaneously, folding the upper section toward the lower section, and releasing the spring biased push buttons when the upper section is perpendicular relative to the middle section.

16. A method of converting an ambulatory device into a table, comprising:

providing a seat cushion including a cushion and a protruding member;

providing a crutch including an upper section, a middle section, a lower section, a first locking pivot joint, and a second locking pivot joint, the upper section including a first end including a crutch pad having a first fastener and a second end including a handle having a first end and a second end, the lower section including an elongated tubular member having a first end and a second end including a crutch tip, the elongated tubular member including a longitudinal bore extending from the first end of the lower section to the second end of the lower section, the first end including an opening providing access to the bore, the bore configured to removably receive the protruding member, the middle section including a first end and a second end, the first end of the middle section connected to the second end of the upper section at the handle via the first locking pivot joint, the second end of the middle section connected to the first end of the elongated tubular member via the second locking pivot joint, the first locking pivot joint pivotable to allow the upper section to pivot relative to the middle section about the handle, the second locking pivot joint pivotable to allow the lower section to pivot relative to the middle section;

pivoting the first locking pivot joint such that the upper section is folded in a perpendicular orientation relative to the middle section;

pivoting the second locking pivot joint such that the elongated tubular member is folded in a perpendicular orientation relative to the middle section and the opening of the longitudinal bore is aligned with the middle section; and attaching the seat cushion to the lower section by inserting the protruding member into the longitudinal bore of the elongated tubular member.

17. The method of claim 16, further comprising:

providing a tabletop panel including a top surface and a bottom surface, the bottom surface comprising one or more fasteners configured to attach to the upper section of the crutch to orient the upper surface of the tabletop panel away from the crutch; and attaching the tabletop panel to the middle section so as to form a horizontal tabletop surface thereon.

18. The method of claim 17, wherein:

the first locking pivot joint includes a first ratchet joint disposed on the first end of the handle and a second ratchet joint disposed on the second end of the handle, the first ratchet joint and the second ratchet joint each including upper receiving pivot arms affixed to the upper section, lower receiving pivot arms affixed to the middle section, and a spring biased push button configured to enable rotation of the first ratchet joint and the second ratchet joint when depressed and configured to lock the first ratchet joint and the second ratchet joint in position when released;

the second locking pivot joint comprises a third ratchet joint and a fourth ratchet joint connected by a tubular receiving member having a first end and a second end, the third ratchet joint and the fourth ratchet joint comprising upper receiving pivot arms affixed to the upper section and a spring biased push button configured to enable rotation of the third ratchet joint and the fourth ratchet joint when depressed and configured to lock the third ratchet joint and the fourth ratchet joint in position when released, the tubular receiving member including a longitudinal bore extending from the first end to the second end of the tubular receiving member, the first end of the elongated tubular member of the lower section extending through the longitudinal bore of tubular receiving member and affixed therein.

19. The method of claim 18, wherein:

pivoting the first locking pivot joint such that the upper section is folded in a perpendicular orientation relative to the middle section comprises depressing the spring biased push button of each of the first ratchet joint and third ratchet joint simultaneously, folding the upper section toward the lower section, and releasing the spring biased push buttons when the upper section is perpendicular relative to the middle section; and pivoting the second locking pivot joint such that the elongated tubular member is folded in a perpendicular orientation relative to the middle section and the opening of the longitudinal bore is aligned with the middle section comprises depressing the spring biased push button of each of the third ratchet joint and fourth ratchet joint simultaneously, folding the lower section toward the upper section, and releasing the spring biased push buttons when the lower section is perpendicular relative to the middle section.

* * * * *